US006322269B1

(12) United States Patent
Witz et al.

(10) Patent No.: US 6,322,269 B1
(45) Date of Patent: Nov. 27, 2001

(54) FREE INK SYSTEM

(75) Inventors: Wolfgang Witz, Elmhurst, IL (US); Gerold D. Anderka, Ellerbek (DE); Bernd Bastiansen; Ralf Polley, both of Wedel (DE)

(73) Assignee: Sanford I L.P., Freeport, IL (US)

( * ) Notice: Subject to any disclaimer, the term of this patent is extended or adjusted under 35 U.S.C. 154(b) by 0 days.

(21) Appl. No.: 09/498,913

(22) Filed: Feb. 4, 2000

(30) Foreign Application Priority Data

Jun. 28, 1999 (DE) ..... 199 30 540

(51) Int. Cl.[7] ..... B43K 5/00
(52) U.S. Cl. ..... 401/198; 401/205
(58) Field of Search ..... 401/198, 199, 401/196, 205

(56) References Cited

U.S. PATENT DOCUMENTS

| | | | | |
|---|---|---|---|---|
| 1,413,827 | | 4/1922 | Briggs . | |
| 3,032,802 | | 5/1962 | Kusama | 15/563 |
| 3,113,336 | | 12/1963 | Langnickel | 15/563 |
| 3,231,924 | * | 2/1966 | Lofgren | 401/198 |
| 3,442,597 | | 5/1969 | Hebborn et al. | 401/259 |
| 3,479,122 | | 11/1969 | Funahashi | 401/199 |
| 3,501,225 | | 3/1970 | Martin et al. | 401/198 |
| 4,410,290 | * | 10/1983 | Ito et al. | 401/198 |
| 4,496,258 | | 1/1985 | Tanaka et al. | 401/206 |
| 4,580,918 | * | 4/1986 | Baker et al. | 401/198 |
| 4,753,546 | | 6/1988 | Witz et al. | 401/258 |
| 5,087,144 | | 2/1992 | Wada et al. | 401/199 |
| 5,290,116 | | 3/1994 | Chang | 401/199 |
| 5,352,052 | | 10/1994 | Kaufmann | 401/199 |
| 5,556,215 | | 9/1996 | Hori | 401/199 |
| 5,865,553 | | 2/1999 | Marie et al. | 401/199 |
| 5,927,885 | | 7/1999 | Duez et al. | 401/199 |
| 6,089,776 | | 7/2000 | Kaufmann | 401/199 |
| 6,095,707 | * | 8/2000 | Kaufmann | 401/198 |

FOREIGN PATENT DOCUMENTS

| | | |
|---|---|---|
| 2229409 | 2/1997 | (CA) . |
| 422 575 | 4/1967 | (CH) . |
| 1 511 395 | 9/1973 | (DE) . |
| 92 05 942 U | 10/1992 | (DE) . |
| 41 15 685 C2 | 1/1995 | (DE) . |
| 195 29 865 A1 | 2/1997 | (DE) . |
| 0516 538 | 12/1992 | (EP) . |
| 0 584 149 B1 | 7/1996 | (EP) . |
| 0 899 128 A1 | 3/1999 | (EP) . |
| 1 029 708 A1 | 8/2000 | (EP) . |
| 48-36844 | 2/1973 | (JP) . |
| WO 92/20530 | 11/1992 | (WO) . |
| WO 97/06962 | 2/1997 | (WO) . |
| WO 98/21052 | 5/1998 | (WO) . |

OTHER PUBLICATIONS

PCT International Search Report for International Application No. PCT/US 00/17575 dated Oct. 17, 2000 (7 sheets).

* cited by examiner

*Primary Examiner*—David J. Walczak
(74) *Attorney, Agent, or Firm*—Foley & Lardner

(57) ABSTRACT

A free ink marking instrument for dispensing a fluid. The instrument includes a feeder, a passage of reduced capillarity surrounding the feeder for conveying at least one of fluid and air to the reservoir during an increasing pressure differential between air in the reservoir and the atmosphere, a porous buffer configured for storing ink during periods of a decreasing pressure differential between air in the reservoir and the atmosphere, and a divider tube separating the buffer and the passage along a majority of the length of the buffer. The fluid and air may enter the feeder through a minor surrounding portion of the buffer during the period of the increasing pressure differential. An ink and air conveyor for use in a free ink marking instrument is also disclosed. A method for compensating for changes in ambient temperature and pressure in a free ink marking instrument is also disclosed.

24 Claims, 2 Drawing Sheets

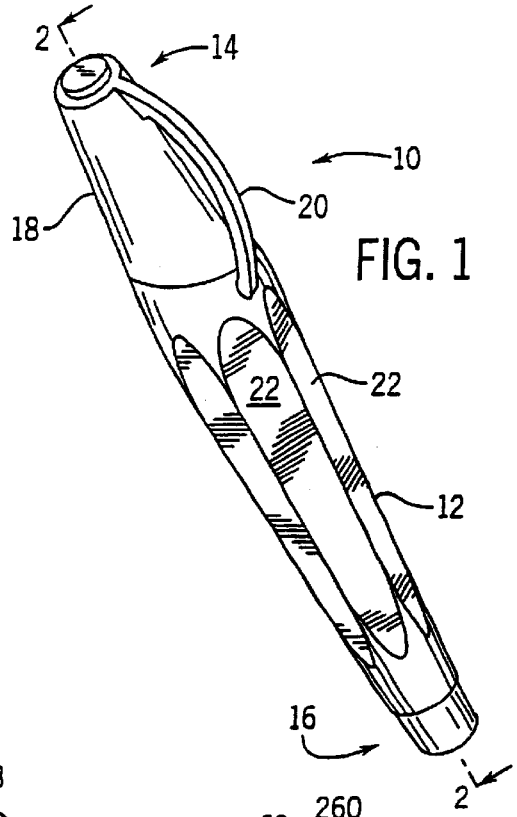
FIG. 1
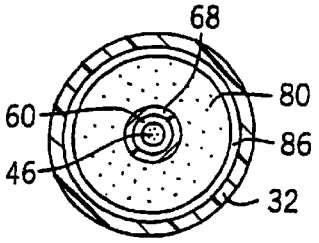
FIG. 3
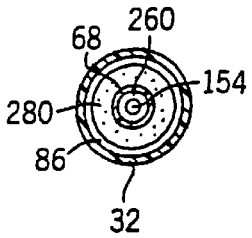
FIG. 7
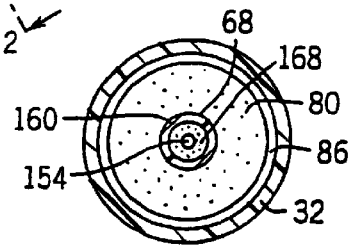
FIG. 5
FIG. 8
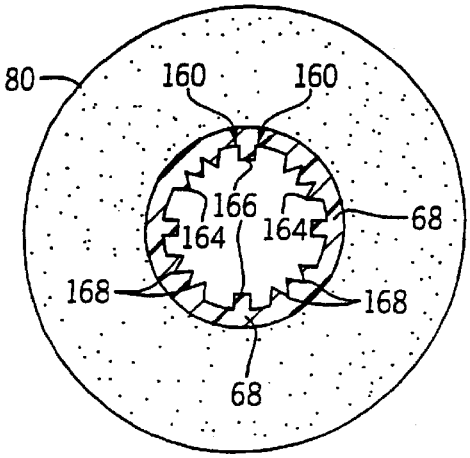
FIG. 9
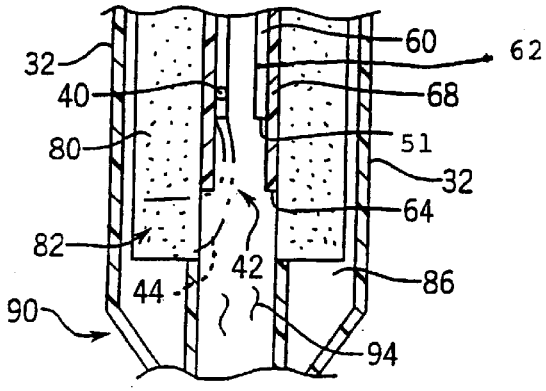

FREE INK SYSTEM

FIELD OF THE INVENTION

The present invention generally relates to a marking utensil. In particular, the present invention relates to a marking utensil that provides hydrostatic stability in response to changes in temperature and pressure.

CROSS-REFERENCE TO RELATED APPLICATIONS

The following patent application is cited by reference and incorporated by reference herein: German Patent Application No. 199 30 540.4 titled "HAND-AUFTRAGGERÄT," filed Jun. 28, 1999.

BACKGROUND OF THE INVENTION

It is well known to provide a pen having free ink that a user may selectively apply to a substrate such as paper. Such known pens typically include a reservoir for storing the ink and a channel for ducting the ink from the reservoir to a marking tip. The ink of such known pens typically has a vapor pressure such that the ink, and any air in the reservoir, expands and contracts in response to changes in ambient temperature and pressure. Such expansion and contraction of air may cause the ink to leak from the writing tip of the pen.

Other such known pens include a buffer for storing excess ink in response to changes in ambient temperature and pressure. The excess ink is typically stored in the front of the buffer near the tip of the pen (i.e., due to gravity). However, such known pens have several disadvantages: the ink capacity of the buffer is limited such that when the buffer is full the excess ink leaks from the pen, and the ink is often permanently stored in the buffer resulting in decreased buffer capacity and wasted ink. Another of such known pens provides for the cleaning of ink from the buffer when the pressure inside the pen is increased by venting air into the pen through an external vent. Such known pens, however, only clean a small portion of the buffer.

Accordingly, it would be advantageous to provide a hydrostatically stable pen that responds to repeated temperature and pressure changes by reducing the accumulation of ink in the buffer without substantially leaking or dripping. It would also be advantageous to provide a pen that optimizes the efficiency of the buffer by purging the buffer during changes in ambient temperature or pressure. It would also be advantageous to provide hydrostatic stability when the pen is oriented in any direction. Other advantages of the subject matter recited in the appended claims will become apparent to those skilled in the art upon review of the specification and the claims.

SUMMARY OF THE INVENTION

The present invention relates to a free ink marking instrument for dispensing a fluid including a housing having an interior defined by a wall and a reservoir for storing the fluid disposed in the housing. The instrument includes a feeder for conveying fluid to a marking tip from the reservoir. The instrument also includes a passage of reduced capillarity relative to the feeder surrounding the feeder for conveying at least one of fluid and air to the reservoir during an increasing pressure differential between air in the reservoir and the atmosphere. The instrument also includes a porous buffer disposed between the wall of the housing and the passage and configured for storing ink during periods of a decreasing pressure differential between air in the reservoir and the atmosphere. The instrument also includes a divider tube separating the buffer and the passage along a majority of the length of the buffer. The fluid and air may enter the feeder through a minor surrounding portion of the buffer during the period of the increasing pressure differential.

The present invention also relates to an ink and air conveyor for use in a free ink marking instrument for dispensing ink onto a substrate such as paper. The instrument includes a housing having an interior including a reservoir for storing the ink and a marking tip coupled to the housing. The conveyor includes a divider tube supported along an axis of the marking instrument. The conveyor also includes a feeder disposed within the divider tube and extending outwardly therefrom toward the marking tip. The conveyor also includes a buffer surrounding a portion of the feeder and extending outwardly from the divider tube. The conveyor also includes a channel adapted for conveying at least one of fluid and air located between an exterior surface of the feeder and an interior surface of the divider tube.

The present invention also relates to a method for compensating for changes in temperature and pressure in a free ink marking instrument. The instrument includes a housing having an interior defined by a wall, a reservoir for storing ink and air disposed in the housing, and a marking tip coupled to the housing. The instrument also includes a buffer having a first portion and a second portion disposed within the housing and a divider tube generally parallel to the wall of the housing. The instrument also includes a feeder configured for conveying air and ink. A first portion of the feeder extends into the divider tube and is spaced from an inner wall thereof. A second portion of the feeder is attached to an inner wall of the divider tube, and a third portion of the feeder extends outwardly from the divider tube toward the marking tip. The method includes drawing air from the atmosphere through a vent near the marking tip to the interior of the housing during periods of increasing ambient pressure or decreasing ambient temperature. The method also includes urging the air through the buffer. The method also includes urging the air from the buffer to the third portion of the feeder. The method also includes urging the air from the third portion of the feeder to the channel. The method also includes urging the air from the feeder to a space between the feeder and the inner wall of the divider tube.

DESCRIPTION OF THE FIGURES

FIG. 1 is a perspective view of a marking instrument according to an exemplary embodiment of the present invention.

FIG. 3 is a cross-sectional view of the marking instrument of FIG. 1 taken along line 3—3 of FIG. 2.

FIG. 5 is a cross-sectional view of the marking instrument of FIG. 4 taken along line 5—5 of FIG. 4.

FIG. 7 is a cross-sectional view of the marking instrument of FIG. 6 taken along line 7—7 of FIG. 6.

FIG. 8 is an enlarged cross-sectional view of the marking instrument of FIG. 4 along line 8—8 of FIG. 4 according to a particularly preferred embodiment.

FIG. 9 is an enlarged fragmentary cross-sectional view of a bubble separation area of the marking instrument of FIG. 1.

DETAILED DESCRIPTION OF THE PREFERRED EMBODIMENTS

Figure 2:
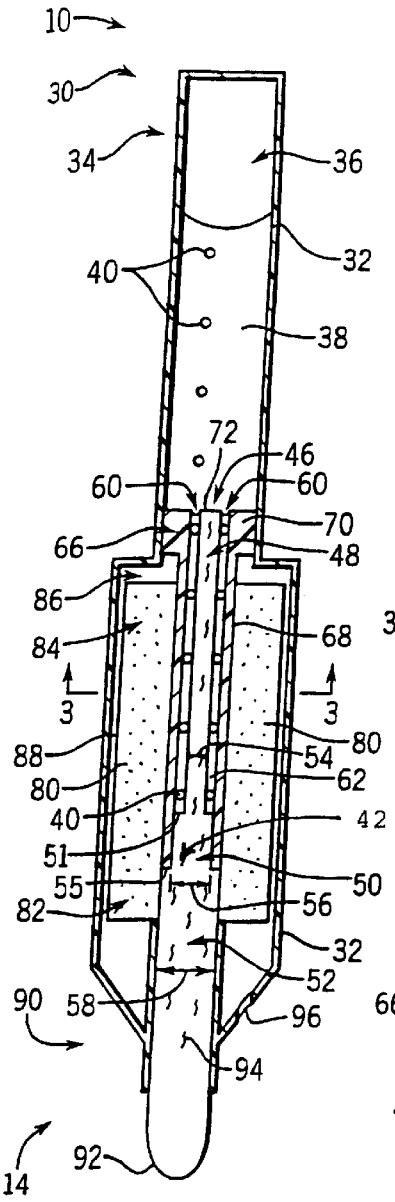
FIG. 2 is a cross-sectional view of the marking instrument of FIG. 1 taken along line 2—2 of FIG. 1.

FIG. 1 shows a writing or marking utensil such as a pen or a highlighter (shown as a marker 10) according to an exemplary embodiment of the present invention. Marker 10 includes a body 12 disposed between a writing end 14 and a butt end 16. A removable cap 18 having a clip 20 is shown attached to writing end 14 of body 12. Cap 18 may be sized to engage end 16 for storage of cap 18 during use of marker 10. According to any preferred or alternative embodiment, a flexible or rigid grip 22 surrounds at least a portion of body 12.

FIG. 2 shows a cross-sectional view of marker 10 according to an exemplary embodiment. Marker 10 includes a housing 30 provided by an exterior wall 32, which defines an interior of marker 10. Housing 30 also provides a reservoir 34 for storing free ink 38. The term "free ink" is defined as liquid ink that may be stored in a cavity and that is free to move or flow in response to external forces (e.g., motion, gravity, pressure, etc.). A user may view such free ink in a column of a writing utensil to determine how much ink is available for use. An ink transfer element or interior channel (shown as a feeder 46) is in fluid communication with reservoir 34 and provides a conduit for transferring ink 38 from reservoir 34 to a marking or writing tip 92. An open channel or feed tube (shown as a passage 60) and an adapter 66 are located about an upper section 48 of feeder 46. A plenum (shown as a head 70) of adapter 66 separates reservoir 34 from the lower portion of marker 10 and secures an inner non-porous divider tube 68 around passage 60. The generally cylindrical interior of adapter 66 is larger than the generally cylindrical upper section 48 of feeder 46 so that passage 60 is in fluid communication with reservoir 34. A buffer 80 surrounds divider tube 68 and at least a portion of a lower section 52 of feeder 46 (see FIG. 3).

Reservoir 34 provides an area for storing ink 38 as shown in FIG. 2. A headspace 36 of air and vapor is located above ink 38, which expands and contracts in response to changes in temperature and pressure. Ink 38 in reservoir 34 typically has a relatively high vapor pressure, so that it can dry quickly when used, and responds significantly to changes in temperature and pressure. A variety of inks such as solvent based (e.g., alcohol) or water based inks may be used with the writing utensil, and the physical properties of different inks may dictate slight differences in the writing instrument (e.g., shapes, sizes, geometries, etc.). According to alternative embodiments, the ink may be water-based and may contain pigments, such as those inks used in MAJOR ACCENT® highlighters and liquid paint felt tip marking and coloring applicators commercially available from Sanford Corporation of Bellwood, Ill. According to other alternative embodiments, the ink may be alcohol and dye based such as those inks used in SHARPIE® marking and writing pens commercially available from Sanford Corporation of Bellwood, Ill. According to still other alternative embodiments, the ink may be alcohol and pigment based such as those inks used in EXPO™ and EXPO2™ white board marker pens and dry erase marking pens commercially available from Sanford Corporation of Bellwood, Ill. According to a preferred embodiment, the ink is compatible with a plastic material such as polypropylene.

Figure 4:
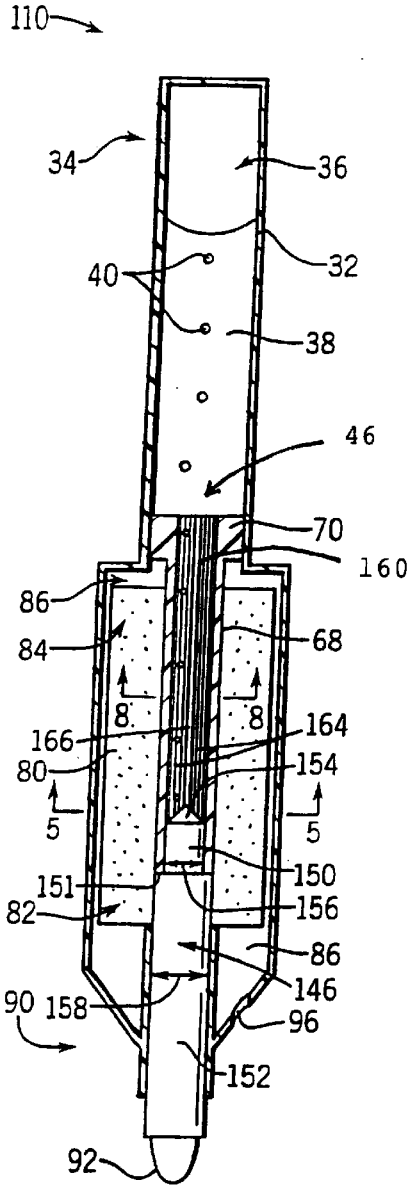
FIG. 4 is a cross-sectional view of the marking instrument of FIG. 1 according to an alternative embodiment of the present invention.

Head 70 of adapter 66 may be held by interference fit within housing 30 as shown in FIG. 2. Divider tube 68 of adapter 66 limits the engagement between feeder 46 and buffer 80, such that buffer 80 and feeder 46 may be in direct contact near lower section 52 of feeder 46. The length of adapter 66 also limits the location where ink 38 from reservoir 34 has access to buffer 80 (i.e., at a bubble separation area 42). According to a preferred embodiment as shown in the FIGURES, divider tube 68 has a length greater than passage 60. According to a particularly preferred embodiment as shown in the FIGURES, head 70 of adapter 66 is integral with divider tube 68 to form a unitary, molded piece. Divider tube 68 is preferably made of a plastic, such as polypropylene, which is generally compatible with ink 38. Passage 60 is preferably tubular, and provides a substantially resistance free path for air and ink to travel from feeder 46 to reservoir 34. According to alternative embodiments, the passage may be any Feeder 46 includes upper section 48 having a first diameter 54, an intermediate section 50 having a second and larger diameter 56, and lower section 52 having a third and still larger diameter 58. Intermediate section 50 includes a ridge (shown as a shoulder 51) that is located proximate a lower end 64 of passage 60. Lower section 52 also includes a ridge (shown as a shoulder 55) located proximate lower end 64 of divider tube 68. Upper section 48 extends from head 70 to shoulder 51 and may be substantially equal in length to passage 60. Intermediate section 50 extends from shoulder 51 to shoulder 55, and lower section 52 extends from shoulder 55 to tip 92. Shoulder 55 abuts against lower end 62 of divider tube 68 and prevents feeder 46 from 11 being pushed or moved toward reservoir 34 during the act of writing with marker 10. Intermediate section 50 is engaged against divider tube 68, divider tube 68 is engaged in an interference fit against buffer 80, and head 70 is engaged in an interference fit against housing 30. Feeder 46 may be integral with tip 92 as shown in FIG. 2, or according to an alternative embodiment as shown in FIG. 4, feeder 46 may be a separate piece from tip 92 (shown located outside of buffer 80).

Feeder 46 and tip 92 are preferably comprised of synthetic resin fibers 94 oriented in a generally vertical direction as shown in FIG. 2. According to a preferred embodiment, fibers 94 are irregular shaped and are somewhat randomly distributed in the feeder. Thus, spaces or capillaries (not shown) are provided somewhat randomly distributed between fibers 94 so that air and ink may pass between fibers 94 (i.e., air may enter and exit feeder 46 and tip 92 between the spaces of fibers 94, unless the spaces are saturated with ink). According to a preferred embodiment as shown in FIG. 3, feeder 46 has a circular shaped cross-section. According to other alternative embodiments, the feeder may have a variety of shaped cross-sections (e.g., toothed, jagged, smooth, etc.). According to a preferred embodiment, the ink transfer element (i.e., feeder 46) is made of an acrylic material (model no. AE553C) or a polyester material (model no. ET-150N) commercially available from Teibow Co. Ltd. of Hamamatsu-shi, Shizuoka-ken, Japan. According to an alternative embodiment, the ink transfer element and the tip may be made of felt or synthetic resin foam. of a variety of shapes, at least in part depending on the shape of the feeder and the adapter.

A nib section 90 attaches tip 92 to housing 30 as shown in FIG. 2. Nib section 90 provides stability and support to feeder 46 and to tip 92. Tip 92 is shown in the FIGURES having a parabolic shape. According to other alternative embodiments, tip 92 may have a variety of shapes such as a chisel shape, a chisel with an angle, pointed or rounded shapes, etc. Without intending to be limited to any particular theory, it is believed that the larger the surface area of the tip, the lower the capillary pressure of the tip when it is saturated with ink. Such reduced capillary pressure of the tip is described by LaPlace, who theorizes that the pressure across an interface is proportional to the surface tension of the liquid and inversely proportional to the mean radius of curvature of such liquid. The LaPlace equation is described in U.S. Pat. No. 4,753,546 issued to Witz et al.

For proper function of the marker 10, the capillarity of tip 92 should be greater than the capillarity of either feeder 46, buffer 80, or passage 60. The term "capillarity" can be defined as the height to which a liquid (e.g., ink) ascends within a pore of a capillary having a given height and diameter, and includes the attractive capillary force (i.e., capillary pressure) of the liquid to the capillary. Without intending to be limited by any particular theory, it is believed that capillary force is inversely proportional to both the pore size of a capillary and the storage capacity of a capillary. According to a preferred embodiment of the present invention, tip 92 has a greater capillarity than that of feeder 46,feeder 46 has a greater capillarity than that of buffer 80, and buffer 80 has a greater eapillarity than that of passage 60. Thus, tip 92 remains wet with ink 38 regardless of the ink distribution inside marker 10, such that marker 10 is always ready to make marks on the substrate during the act of writing.

Buffer 80 may be porous and includes a volume sufficient for retaining ink 38 and air in response to changes in temperature or pressure within reservoir 34. If the ink-retaining capacity of buffer 80 is not exceeded, then the capillary pressure of buffer 80 will retain excess ink 38. An air intake (shown as an air entry hole 96) in housing 30 may provide an air vent in communication with the atmosphere. (Air may also enter marker 10 through capillary spaces surrounding writing tip 92.) A space for holding air (shown as a gap 86) surrounds an exterior surface 88 of buffer 80. Air from hole 96 may enter buffer 80 through external surface 88. The size of buffer 80 may be selected in accordance with the air volume of marker 10 needed to hold the quantity of excess ink. For overall hydrostatic stability, the capillarity of buffer 80, the capillarity of feeder 46, and the capillarity of passage 60 are selected so that marker 10 does not substantially leak in response to changes in temperature and pressure. According to a preferred embodiment, buffer 80 has a capacity of about 40% relative to the size of reservoir 34. According to a particularly preferred embodiment, buffer 80 may retain or store about 2.8 ml of ink. Buffer 80 may be made of a variety of fibrous or porous materials, and its porosity and capillary nature may be selected for compatibility with the particular ink used in the writing utensil. According to a particularly preferred embodiment of the present invention, the buffer is made from a hydrophilic (model no. D-2605) or a hydrophobic (model no. D-2611) linear polyolefin fiber resin commercially available from Filtrona Richmond, Inc. of Richmond, Va. According to alternative embodiments, buffer 80 may be made of ceramics, porous plastics such as open cell foams, acrylics, sponges, etc. According to other alternative embodiments, buffer 80 may be made of hydrophilic or hydrophobic foam, such as polyurethane.

The air and vapor in reservoir 34 responds to changes in pressure and temperature. At equilibrium, the pressure of the air and vapor in reservoir 34 is at a pressure slightly less than ambient pressure, due to the height of ink 38 in reservoir 34 above tip 92. The term "ambient pressure" is defined as the pressure of the atmosphere outside of the marker. At such slightly lower pressure of air and vapor in reservoir 34, ink 38 is retained in marker 10. To begin the act of writing with marker 10, ink 38 is ducted from reservoir 34 through feeder 46 to tip 92. If any ink is stored in buffer 80 during writing, such stored ink is preferentially taken by feeder 46 because of the greater capillarity of feeder 46 relative to buffer 80.

When cap 18 is removed from body 12, marker 10 responds to changes in ambient pressure and ambient temperature (i.e., pressure and temperature differentials) to reach equilibrium (i.e., the pressure slightly less than ambient pressure). The term "pressure differential" is defined as the difference in pressure between the air and vapor inside reservoir 34 and ambient pressure. The term "increasing pressure differential" is defined as the increase in pressure of the air and vapor inside reservoir 34 in response to an increasing ambient pressure. The term "decreasing pressure differential" is defined as the decrease in pressure of the air and vapor inside reservoir 34 in response to a decreasing ambient pressure. Without intending to be limited to any particular theory, it is believed that the air and vapor inside the marker responds "directly" to changes in ambient pressure and temperature to reach equilibrium.

An increasing pressure differential situation occurs, for example, during a "descent" in a pressurized airplane. If ink 38 is stored in buffer 80 during an increasing pressure differential situation, then feeder 46 seeks ink 38 from buffer 80 and passage 60 seeks ink from feeder 46. If buffer 80 is substantially free of ink 38 during an increasing pressure differential situation, then feeder 46 seeks air from buffer 80 and passage 60 seeks air from feeder 46. Ink and air flow behaves similarly when a user writes with and discharges ink 38 onto a substrate (e.g., paper, cloth, marker board, etc.).

During an increasing pressure differential situation (or decreasing temperature differential situation) where buffer 80 is near empty (i.e., substantially free of ink 38), the difference in pressure between the air and vapor in reservoir 34 and ambient pressure may become so great that a bubble pressure of marker 10 is reached. The term "bubble pressure" is defined as the pressure differential necessary to draw or vent external air through hole 96, through buffer 80, feeder 46, passage 60 and ultimately into reservoir 34. Such venting of air adds to the volume of air in reservoir 34 to maintain the pressure differential between air in reservoir 34 and ambient conditions outside of marker 10 at a relatively constant level. The vented air is preferentially drawn through passage 60 into reservoir 34 (rather than through feeder 46) because passage 60 has a larger capillary space, and thus lower resistance, available for the air than does feeder 46. The increasing pressure differential transports ink 38 and/or air, while tip 92 remains wet with ink 38 for quick writing and reduced leakage.

As ambient pressure and temperature changes, the air inside reservoir 34 will expand and contract and accordingly force ink 38 out of (or pull ink into) a vent channel 44 (shown in phantom lines in FIG. 9). If insufficient ink exists in the buffer during an increasing pressure differential situation, air (shown as bubbles 40) enters vent channel 44 and creates the desired equilibrium. During such increasing pressure differential situation, air will first urge ink out of buffer 80, and then will follow the path of least resistance and will accordingly migrate toward lower section 52 of feeder 46. The air will then travel through and along feeder 46 and will enter passage 60 (since air does not substantially enter the feeder through adapter 66 or divider tube 68).

Marker 10 may also experience a decreasing pressure differential situation. A decreasing pressure differential situation occurs, for example, during an "ascent" in a pressurized airplane, during which ambient pressure may decrease to about two-thirds that of normal atmospheric pressure (i.e., two-thirds of one atmosphere (760 mm mercury)). As a result of a decreasing pressure differential, air in reservoir 34 expands forcing ink 38 toward writing end 14 of marker 10. If buffer 80 is not fully saturated with ink 38 during a decreasing pressure differential situation, then buffer 80 (due to its capillary force) will absorb excess ink from reservoir 34. Since marker 10 can compensate for both increasing and decreasing pressure and temperature differentials, the hydrostatic balancing of air in the marker 10 may be achieved to provide a constant ink flow, and to inhibit ink from dripping or leaking from tip 92 when marker 10 is oriented in any direction (e.g., horizontal, vertical, etc.).

Feeder 46 includes bubble separation area 42 as shown in FIGS. 2 and 9. Bubble separation area 42 is located between a lower end 82 of buffer 80 and shoulder 51 to allow bubbles 40 to form and rise to the surface of ink 38 in reservoir 34. The length of bubble separation area 42 in a preferred embodiment is in the range of about 2–6 mm, most preferably about 2–4 mm, and still more preferably about 3–4 mm. The location of bubble separation area 42 near tip 92 functions to purge lower end 82 of buffer 80 of ink 38 during an increasing pressure differential situation. The location of bubble separation area 42 is advantageous for at least two reasons: it assists in more completely emptying or purging buffer 80 of ink 38; and it reduces the accumulation of ink 38 in lower end 82 of buffer 80, which may contribute to leakage of ink 38 from marker 10.

FIGS. 4 through 5 show a marker 110, an alternative embodiment of marker 10. Marker 110 is modified from marker 10 in two respects: the shape of feeder 46 is changed, and capillaries 160 replace passage 60. Other than these modifications, the construction and performance of marker 110 is substantially identical to that of marker 10, and like reference numerals are used to identify like elements. Referring to FIG. 4, a feeder 146 includes a lower section 152 and an upper section 150 having a shoulder 151. Shoulder 151 abuts against divider tube 68. Lower section 152 has a diameter 158 greater than a diameter 156 of section 150. Section 150 may include an apex (shown as a point 154) in a fluid exchange relationship to capillaries 160. Point 154 increases the surface area of the interface between section 150 of feeder 146 and capillaries 160 (see FIG. 5). Capillaries 160 are molded or cut into head 70 and divider tube 68 of adapter 66 to form corner sections (shown as grooves 168 in FIG. 8). Grooves 168 may be formed from a saw-shaped protrusion (shown as a jagged protrusion 164) or from a smooth protrusion (shown as a rectangle 166). Grooves 168 function as capillaries for transporting both air and ink between reservoir 34 and tip 92.

Figure 6:
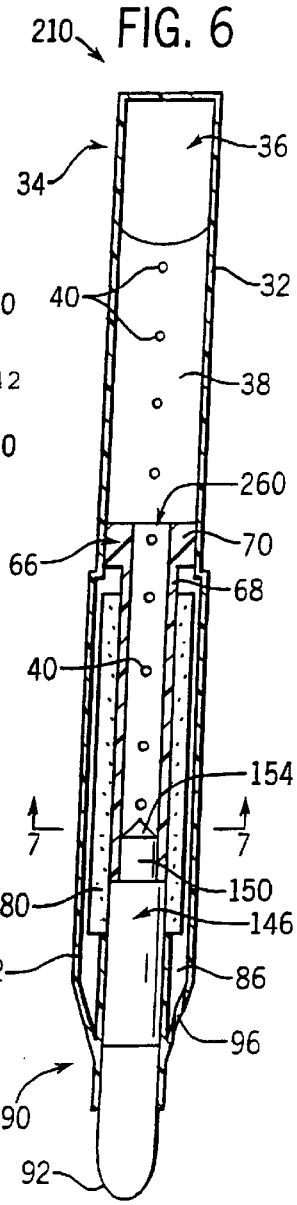
FIG. 6 is a cross-sectional view of the marking instrument of FIG. 1 according to an alternative embodiment of the present invention.

FIGS. 6 through 7 show a marker 210, an alternative embodiment of marker 110. Marker 210 is modified from marker 110 in two respects: capillaries 160 have been omitted, and the diameter of marker 210 is of a reduced size. Other than these modifications, the construction and performance of marker 210 is substantially identical to that of marker 110, and like reference numerals are used to identify like elements. Referring to FIG. 6, a passage 260, similar to passage 60, is surrounded by adapter 66 and divider tube 68. Upper section 150 of feeder 146 is in fluid communication with ink 38. Bubbles 40 may be formed at the interface between point 154 of feeder 146 and the ink in passage 260. Passage 260 provides a channel for conveying ink 38 from reservoir 34 to writing tip 92, and a channel for conveying bubbles 40 from gap 86 to reservoir 34. Referring to FIG. 7, marker 210 has a smaller overall diameter than the overall diameter of marker 110. Thus, marker 210 holds less ink than marker 110, and the size of a buffer 280 of marker 210 is smaller than the size of buffer 80 of marker 110.

According to a particularly preferred embodiment, the marker 10 may be sized to hold about 7.0 ml of ink, the buffer may be sized to hold about 2.8 ml of ink, and the reservoir may be sized to hold about 4.0–5.0 ml of air. The length of the marker 10 is preferably about 5.0 inches. The butt end of the marker 10 preferably has a diameter of about 0.5 inches and the midsection of the marker 10 preferably has a diameter of about 0.8 inches. The marker 10 preferably has a generally triangular cross-section.

It is important to note that the construction and arrangement of the elements of the writing utensil shown in the exemplary embodiments is illustrative only. Although only a few exemplary embodiments of the present invention have been described in detail in this disclosure, those skilled in the art who review this disclosure will readily appreciate that many modifications are possible (such as variations in sizes, structures, shapes and proportions of the various elements, values of parameters, mounting arrangements, use of materials, etc.) without materially departing from the novel teachings and advantages of the invention. According to alternative embodiments, the size of the capillaries, feeders, passages, tips or buffers may depend on the respective construction of the writing utensil and may be determined by experimentation. The capillarity of the feeders, passages, tips, buffers and capillaries can be selected to provide for optimum performance with inks of different physical properties (e.g., viscosity, vapor pressure, etc.). Accordingly, all such modifications are intended to be included within the scope of the invention as defined in the appended claims. Other substitutions, modifications, changes and omissions may be made in the design, operating conditions and arrangement of the preferred embodiments without departing from the spirit of the invention as expressed in the appended claims.

It is important to note that the terms "channel" is not meant as a term of limitation, insofar as the structures described in this specification (or alternative and/or equivalent structures) may serve to provide for the flow, channeling, ducting, transferring, transporting, etc. of a fluid through a passage, chamber, tube, conduit, inlet, intake, outlet, discharge, port, etc.

What is claimed is:

1. A free ink marking instrument for dispensing a fluid including a housing having an interior defined by a wall and a reservoir for storing the fluid disposed in the housing, comprising:

a feeder for conveying fluid to a marking tip from the reservoir;

a passage of reduced capillarity relative to the feeder surrounding the feeder for conveying at least one of fluid and air to the reservoir during an increasing pressure differential between air in the reservoir and the atmosphere;

a porous buffer disposed between the wall of the housing and the passage and configured for storing ink during periods of a decreasing pressure differential between air in the reservoir and the atmosphere; and a divider tube separating the buffer and the passage along a majority of the length of the buffer;

whereby the fluid and air may enter the feeder through a minor surrounding portion of the buffer during the period of the increasing pressure differential.

2. The marking instrument of claim 1 further comprising an adapter for separating the reservoir from the buffer.

3. The marking instrument of claim 2 wherein the tip has a greater capillarity than the feeder, the feeder has a greater capillarity than the buffer and the buffer has a greater capillarity than the passage of reduced capillarity.

4. The marking instrument of claim 2 wherein the divider tube and the buffer are generally coaxial and the buffer extends a greater length toward the marking tip than does the divider tube.

5. The marking instrument of claim 4 wherein the feeder and the passage are generally coaxial and the divider tube extends a greater length toward the marking tip than does the passage.

6. The marking instrument of claim 4 wherein the feeder has a first portion having a diameter greater than a second portion of the feeder and wherein the first portion of the feeder is disposed between the divider tube and the marking tip.

7. The marking instrument of claim 4 wherein the feeder includes a fibrous material.

8. The marking instrument of claim 4 wherein the feeder includes a bubble separation area of about 2 to 6 mm in length.

9. The marking instrument of claim 4 wherein the buffer has an ink retaining capacity of about two-fifths relative to the ink retaining capacity of the reservoir.

10. The marking instrument of claim 4 wherein when an increasing pressure differential between air in the reservoir and the atmosphere is formed and the buffer is substantially free of ink, air is vented from a gap adjacent the buffer, through the buffer, through the feeder, and through the passage.

11. The marking instrument of claim 4 wherein when an increasing pressure differential between air in the reservoir and the atmosphere is formed a bubble of air forms at a location near a lower two-fifths of the housing relative to the marking tip.

12. The marking instrument of claim 4 wherein when an increasing pressure differential between air in the reservoir and the atmosphere is formed a bubble of air forms between the first portion of the feeder and the passage of reduced capillarity.

13. The marking instrument of claim 4 wherein when an increasing pressure differential between air in the reservoir and the atmosphere is formed a bubble of air is conveyed from the feeder to the reservoir through the passage of reduced capillarity.

14. A method for compensating for changes in ambient temperature and pressure in a free ink marking instrument including a housing having an interior defined by a wall, a reservoir for storing ink and air disposed in the housing, a marking tip coupled to the housing, a buffer having a first portion and a second portion disposed within the housing, a divider tube generally parallel to the wall of the housing, a feeder configured for conveying air and ink, a first portion of the feeder extending into the divider tube and spaced from an inner wall thereof, a second portion of the feeder attached to an inner wall of the divider tube, a third portion of the feeder extending outwardly from the divider tube toward the marking tip, comprising the steps of:

drawing air from the atmosphere through a vent near the marking tip to the interior of the housing during a period of an increasing ambient pressure or a decreasing ambient temperature;

urging the air through the buffer;

urging the air from the buffer to the third portion of the feeder;

urging the air from the third portion of the feeder to a channel; and urging the air from the feeder to a space between the feeder and the inner wall of the divider tube.

15. The method of claim 14 wherein urging the air through the buffer also purges ink from the first portion and the second portion of the buffer.

16. The method of claim 15 wherein the ink in the first portion of the buffer is purged before the ink in the second portion of the buffer is purged.

17. The method of claim 15 wherein the channel is provided at least partially between the feeder and the divider tube.

18. An ink and air conveyor for use in a free ink marking instrument for dispensing ink onto a substrate such as paper, the instrument including a housing having an interior including a reservoir for storing the ink and a marking tip coupled to the housing, comprising:

a divider tube supported along an axis of the marking instrument;

a feeder disposed within the divider tube and extending outwardly therefrom toward the marking tip;

a buffer surrounding a portion of the feeder and extending outwardly from the divider tube; and a channel adapted for conveying at least one of fluid and air located between an exterior surface of the feeder and an interior surface of the divider tube;

wherein the feeder has a greater capillarity than the buffer and the buffer has a greater capillarity than the channel.

19. The conveyer of claim 18 wherein the divider tube has a length greater than a length of the channel.

20. The conveyer of claim 19 wherein the feeder includes a first portion attached to the buffer and a shoulder for engaging the divider tube.

21. The conveyor of claim 20 wherein the feeder includes a second portion coaxial with the channel and having a diameter less than a diameter of the first portion.

22. The conveyer of claim 18 wherein the tip has a greater capillarity than the channel.

23. The conveyer of claim 22 wherein the tip has a greater capillarity than the buffer.

24. The conveyer of claim 23 wherein the tip has a greater capillarity than the feeder.

* * * * *

UNITED STATES PATENT AND TRADEMARK OFFICE

CERTIFICATE OF CORRECTION

PATENT NO. : 6,322,269 B1
DATED : November 27, 2001
INVENTOR(S) : Wolfgang Witz et al.

It is certified that error appears in the above-identified patent and that said Letters Patent is hereby corrected as shown below:

Title page,
Item [73], should read as follows: -- Sanford L.P., Freeport, IL --

Signed and Sealed this

Fifteenth Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,322,269 B1
DATED : February 4, 2000
INVENTOR(S) : Witz et al.

It is certified that error appears in the above-identified patent and that said Letters Patent is hereby corrected as shown below:

Title page,
Item [73], Assignee, "Sanford I L.P." should be -- Sanford L.P. --.

Signed and Sealed this

Twenty-first Day of January, 2003

JAMES E. ROGAN
*Director of the United States Patent and Trademark Office*